United States Patent [19]

Collier

[11] Patent Number: 4,673,350

[45] Date of Patent: Jun. 16, 1987

[54] BURNER ASSEMBLY FOR RADIANT TUBE HEATING SYSTEM

[75] Inventor: David W. Collier, Hales Corners, Wis.

[73] Assignee: Eclipse, Inc., Rockford, Ill.

[21] Appl. No.: 900,529

[22] Filed: Aug. 26, 1986

[51] Int. Cl.[4] ..... F23D 15/02

[52] U.S. Cl. ..... 431/353; 126/91 A

[58] Field of Search ..... 431/353, 350, 352; 126/91 A; 432/209

[56] References Cited

U.S. PATENT DOCUMENTS

| | | | |
|---|---|---|---|
| 3,570,471 | 3/1971 | Lazaridis | 126/91 A |
| 4,047,881 | 9/1977 | Eschenauer et al. | 126/91 A |
| 4,062,343 | 12/1977 | Spielman | 126/91 A |
| 4,310,303 | 1/1982 | Collier | 432/209 |
| 4,401,099 | 8/1983 | Collier | 126/91 |
| 4,431,403 | 2/1984 | Nowak et al. | 431/352 X |
| 4,629,414 | 12/1986 | Buschulte et al. | 431/353 X |

*Primary Examiner*—Edward G. Favors

*Attorney, Agent, or Firm*—Leydig, Voit & Mayer

[57] ABSTRACT

A burner assembly for heating a U-shaped radiant tube. The burner assembly includes a generally conical burner nozzle supported on the end of a gas supply pipe and disposed within an inner tube which, in turn, is located within the radiant tube. The burner nozzle may be adjusted selectively back and forth within the inner tube to change the ratio of primary and secondary combustion air supplied to the nozzle and thereby change the length of the flame produced by the burner assembly.

7 Claims, 6 Drawing Figures

BURNER ASSEMBLY FOR RADIANT TUBE HEATING SYSTEM

BACKGROUND OF THE INVENTION

This invention relates generally to a burner assembly and, more particularly, to a burner assembly for a radiant tube heating system.

A typical radiant tube heating assembly includes a U-shaped radiant tube located within a furnace and having input and return legs extending through the walls of the furnace. As gas-fired burner assembly is located in the input leg of the radiant tube and produces a high temperature flame which effects heating of the tube. Exhaust gases flow into the return leg and are discharged from the system through a flue adjacent the free end of the return leg.

To effect efficient heating and clean combustion, it is desirable that the high fire flame of the burner assembly just reach the return bend of the U-shaped radiant tube such that fingers of the flame are just visible in the return leg of the tube. In most commercially available radiant tube heating systems, combustion air is premixed with the gaseous fuel upstream of the burner nozzle of the burner assembly. The length of the flame is controlled by adjusting the ratio of combustion air to fuel and is set on a trial and error basis by changing the fuel/air ratio while viewing the flame length down the return tube.

SUMMARY OF THE INVENTION

The general aim of the present invention is to provide a radiant tube heating system having a new and improved burner assembly which enables the flame length to be more easily and precisely established and which, at the same time, is capable of being used universally with radiant tubes of widely varying sizes.

A more detailed object of the invention is to achieve the foregoing by providing a burner assembly having a burner nozzle which coacts uniquely with an inner tube disposed within the radiant tube and which may be selectively adjusted along the length of the inner tube to enable the length of the flame to be set easily and precisely.

Still another object of the invention is to advantageously use the adjustability of the burner nozzle relative to the inner tube to enable the flame length to be established properly for various radiant tube diameters and high fire inputs.

The invention also resides in the novel construction of the burner nozzle to spin the combustion air and to reduce clogging of the nozzle.

These and other objects and advantages of the invention will become more apparent from the following detailed description when taken in conjunction with the accompanying drawings.

DETAILED DESCRIPTION OF THE PREFERRED EMBODIMENT

Figure 1:
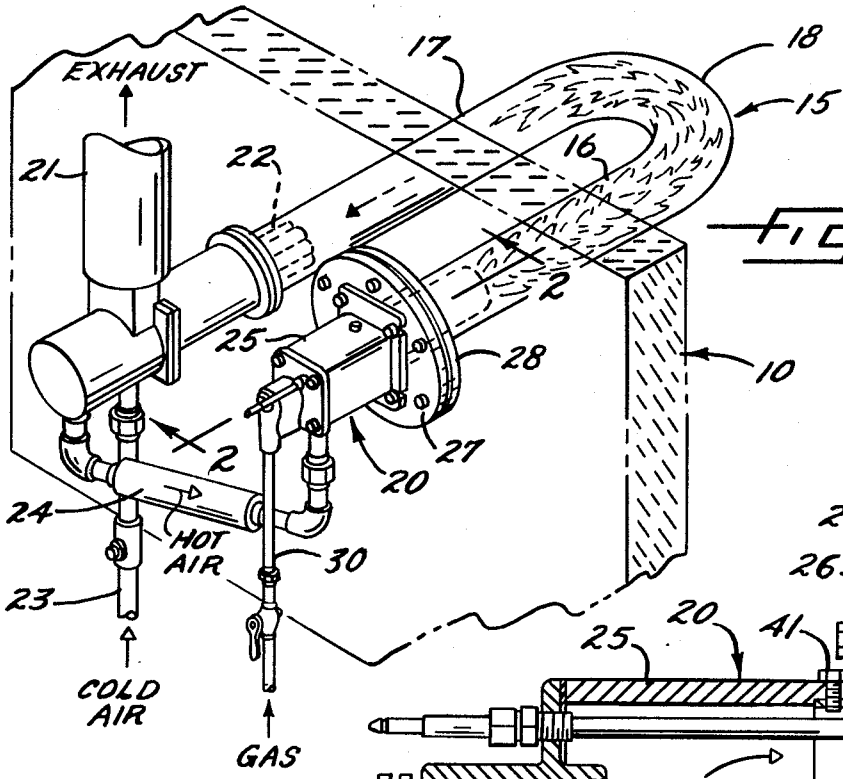
FIG. 1 is a fragmentary perspective view of an exemplary radiant tube heating system equipped with a new and improved burner assembly incorporating the unique features of the present invention.

For purposes of illustration, the invention has been shown in the drawings in conjunction with a radiant tube heating system of the type which is conventionally used to heat the chamber of a furnace such as a heat treating furnace. One wall 10 of a furnace has been shown in FIGS. 1 and 2 and is typically made of refractory material 11 whose outer side is covered by a metal skin 12.

The heating system includes a radiant tube 15 disposed within the furnace chamber and made of ceramic or other suitable heat-resistant material. In this particular instance, the radiant tube generally is in the shape of a U and includes straight input and return legs 16 and 17 (FIG. 1) integrally connected by a curved bend 18. The free end portions of the legs 16 and 17 extend outwardly through the furnace wall 10 and are suitably secured to the wall.

A burner assembly 20 is secured to and is partially disposed within the input leg 16 of the radiant tube 15 and is operable to produce a high temperature flame. As shown in FIG. 1, the flame shoots down the input leg 16 of the tube and curves around the bend 18 thereof. Products of combustion flow reversely through the return leg 17 of the tube 15 and are exhausted through a flue 21 located outside of the furnace wall 10. A recouperator 22 of known construction is located in the return leg 17 upstream of the flue and extracts heat from the products of combustion. Fresh air is supplied to the recouperator via a pipe 23, is heated within the recouperator and is supplied as preheated combustion air to the burner assembly 20 by way of a pipe 24 extending between the recouperator and the burner assembly. It should be understood, however, that the combustion air supplied to the burner assembly need not necessarily be preheated.

In general, the burner assembly 20 includes an outer housing 25 (FIG. 2) having a mounting flange 26 which is releasably secured to an adaptor flange 27 and a mounting flange 28 on the free end of the input leg 16 of the radiant tube 15. The combustion air pipe 24 extends into one side of the housing 25 while a gas line 30 communicates with an L-shaped fitting 31 at the outer end of the housing. Connected to the fitting 31 is the rear end of an elongated gas supply pipe 34 located centrally of the radiant tube 15 and having a forward end which extends into the radiant tube to a point short of the inner side of the furnace wall 10. A burner nozzle 35 is mounted on the forward end portion of the gas supply pipe 34 and is adapted to receive a mixture of gas and combustion air. The electrode 36 of an elongated spark rod 37 is positioned just downstream of the nozzle and serves to ignite the mixture so as to produce a flame which shoots down the input leg 16 of the radiant tube 15. A viewing sight 38 at the outer end of the fitting 31 enables the flame in the input leg to be seen by the operator of the furnace.

Efficient heating and clean combustion are optimized when the flame produced by the burner assembly 20 extends into the bend 18 of the radiant tube 15 just sufficiently far that short fingers of the flame are just visible when the flame is viewed down the return leg 17 of the radiant tube. In accordance with the primary aspect of the present invention, adjustment of the flame length for radiant tubes of various diameters and lengths is facilitated by mounting the burner nozzle 35 for back and forth adjustment relative to an inner tube 40 (FIGS. 2 and 3) and by advantageously using the inner tube to control the flow of primary combustion air to the nozzle.

More specifically, the inner tube 40 is made of a temperature resistant metal and is telescoped into the radiant tube 15 and over the gas supply pipe 34 and the burner nozzle 35. At its rear end, the inner tube 40 is secured to the burner housing 25 by screws 41, only one of which is visible in FIG. 2. The forward end of the inner tube 40 is located approximately in the same plane as the inner side of the furnace wall 10. The spark rod 37 extends through the inner tube 40 adjacent the upper side thereof.

In carrying out the invention, the burner nozzle 35 is shaped as a tubular frustum 45 which is located within the inner tube 40 and which increases in diameter upon progressing forwardly. Formed integrally with the rear end of the frustum or cone 45 is a sleeve 46 (FIG. 2) which is telescoped over the forward end portion of the gas supply pipe 34. The nozzle 35 normally is secured rigidly to the supply pipe 34 by a screw 47 but, by loosening the screw, the nozzle may be adjusted back and forth along the pipe and within the inner tube 40.

Figure 2:
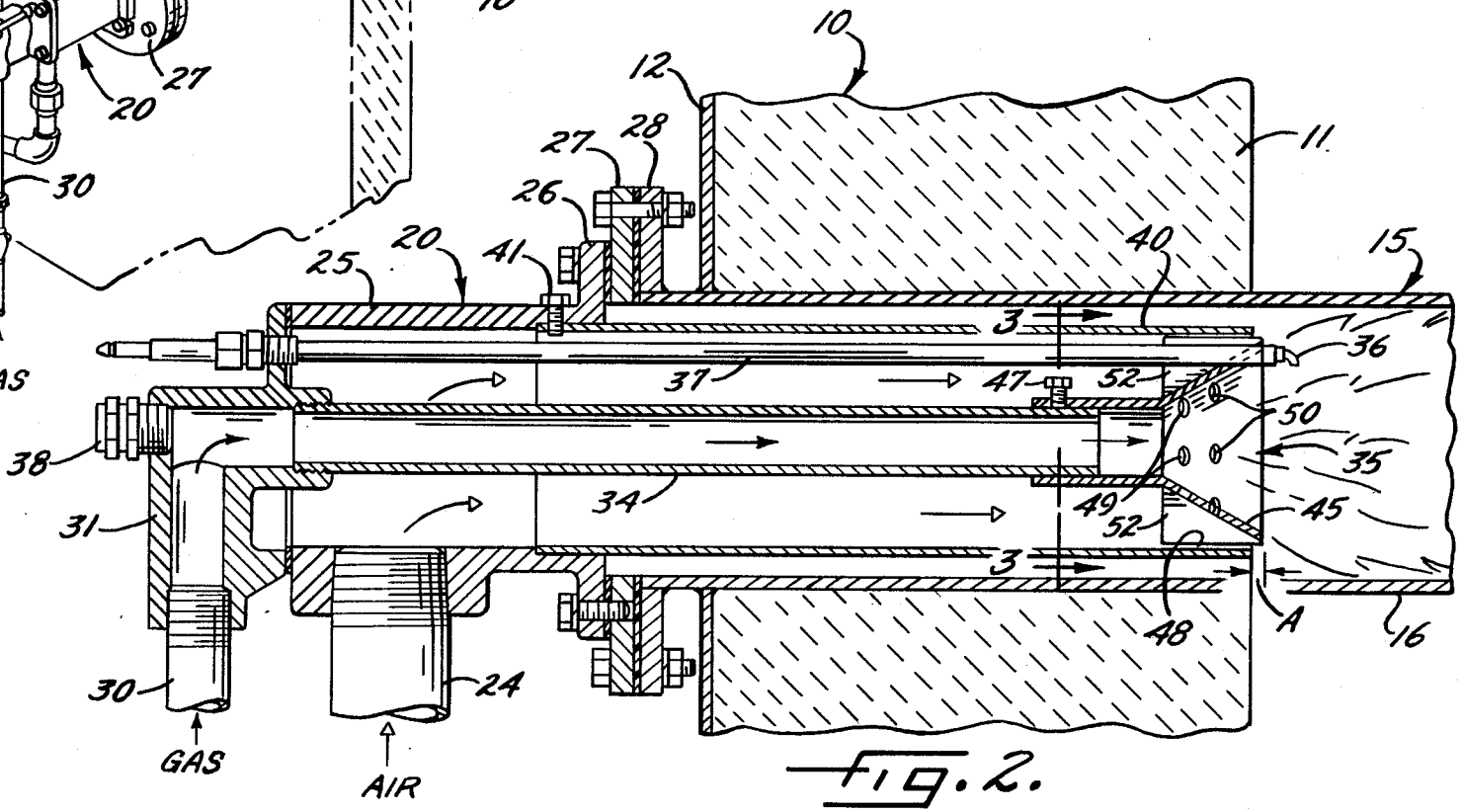
FIG. 2 is an enlarged fragmentary cross-section taken substantially along the line 2—2 of FIG. 1.
Figure 3:
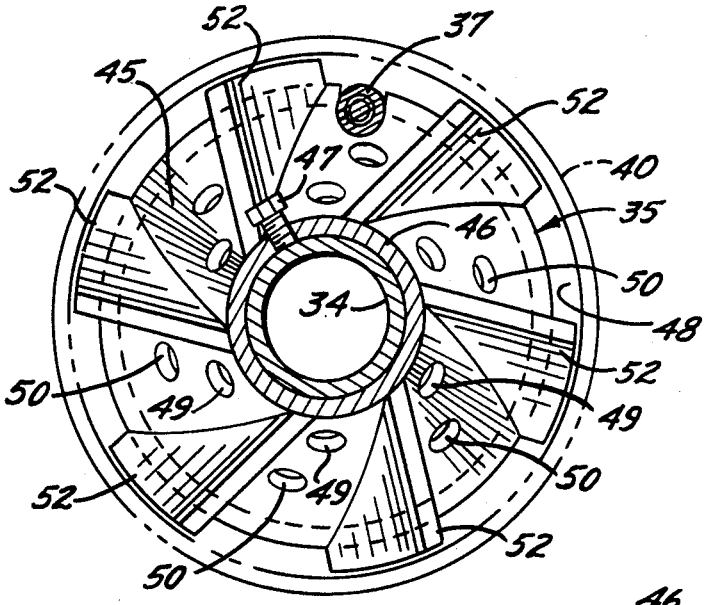
FIG. 3 is an enlarged cross-section primarily showing the burner nozzle and taken substantially along the line 3—3 of FIG. 2.
Figure 4:
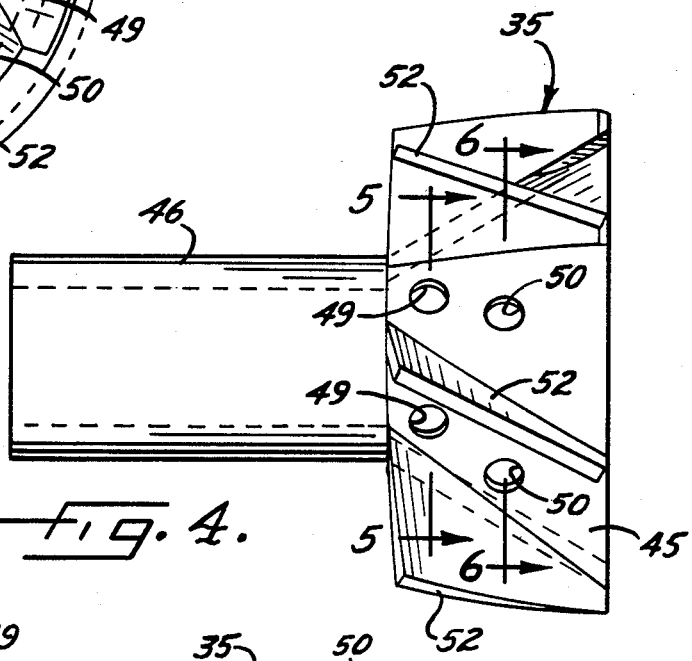
FIG. 4 is a side elevational view of the burner nozzle illustrated in FIG. 3.
Figure 5:
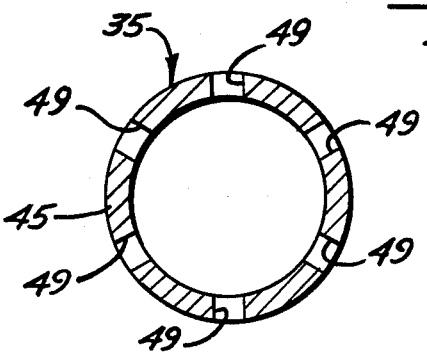
FIGS. 5 and 6 are cross-sections taken along the lines 5—5 and 6—6, respectively, of FIG. 4.
Figure 6:
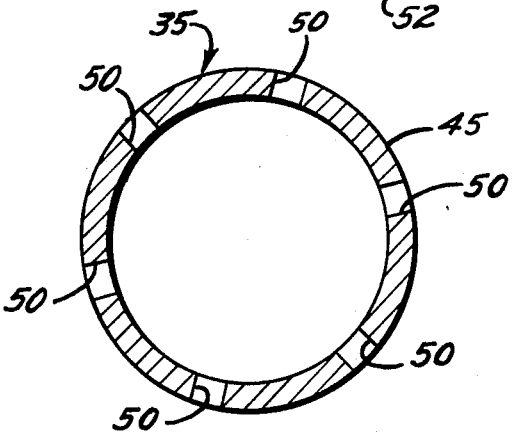

As shown in FIGS. 2 and 3, the forward end portion of the burner cone 45 is spaced radially inwardly from the inner tube 40 by a short distance and coacts therewith to define an annular passage or gap 48 accommodating the flow of secondary combustion air out of the forward end of the inner tube. Primary combustion air is delivered into the nozzle 35 by way of angularly spaced openings or holes 49 and 50 formed through the cone 45, the row of holes 49 being spaced axially from the holes 50. To promote mixing of the combustion air with the gaseous fuel in the nozzle 35, several fins 52 are secured to and are spaced angularly around the outer surface of the cone. The fins are inclined relative to the axis of the cone and impart a spinning action to both the primary and secondary combustion air. It will be noted that the nominal radial width of the passage or gap 48 for secondary combustion air remains constant regardless of the diameter of the radiant tube 15.

In operation of the burner 20, gas flows into the nozzle 35 by way of the supply pipe 34 while primary combustion air flows into the nozzle through the holes 49 and 50 and mixes with the gas. By virtue of the fins 52, turbulence is induced in the primary combustion air to effect thorough and vigorous mixing of the fuel and air. As the mixture is discharged from the nozzle, it is ignited by the electrode 36 so as to produce the flame. Combustion is supported by secondary combustion air which, after being spun by the vanes 52, is discharged into the fuel/air mixture through the annular gap 48 at the forward end of the tube 40.

As shown in FIG. 2, the forward end of the cone 45 is spaced forwardly from the forward end of the inner tube 40 by a dimension "A". By loosening the screw 47 and adjusting the cone forwardly so as to increase the dimension "A", the flame may be made longer. Conversely, the flame may be shortened by adjusting the cone rearwardly so as to decrease the dimension "A". When the cone is adjusted forwardly, the holes 49 and 50 are moved closer to the forward end of the tube 40 and, at the same time, the width of the annular gap 48 is increased. As a result, the cone is supplied with a lesser quantity of primary combustion air and with a greater quantity of secondary combustion air so as to effect a more gradual mixing of the fuel and air and to produce a longer flame. When the cone is adjusted rearwardly, the ratio of primary air to secondary air is increased thereby to produce more vigorous mixing and a shorter flame.

With the foregoing arrangement, the flame may be lengthed or shortened simply by adjusting the position of the nozzle 35. As a result and by virtue of the tube 40, the same burner assembly 20 may be used universally with radiant tubes of various diameters and lengths, the length of the tube being related to the high fire input of the tube. The following table indicates the nominal dimension "A" which should be used for tubes of various diameters and high fire inputs:

Dimension "A" for Various Radiant Tube Diameters And High Fire Inputs

| Radiant Tube Diameter | High Fire Input, Btu/Hr. in 1000's 0 – 50 | 50 – 100 | 100 – 150 | 150 – 200 |
|---|---|---|---|---|
| Up to 4" | 1/8" | | 1/4" | 3/8" |
| 5" | 1/8" | 1/4" | 3/8" | |
| 6" Or More | 1/8" | 1/4" | 3/8" | |

Thus, the dimension "A" is initially set at the proper nominal value and then the length of the flame is confirmed by viewing down the return leg 17 of the radiant tube 15. If necessary, the dimension "A" can then be adjusted slightly to cause the flame to be of proper length.

In addition to enabling precise and easy adjustment of the flame length, the conical nozzle 35 effects good mixing of both the primary and secondary combustion air. Moreover, the unique design of the nozzle reduces the danger of ports becoming clogged in the event the preheated combustion air should crack the gaseous fuel into carbon.

I claim:

1. A radiant tube heating system comprising an outer radiant tube made of heat-resistant material, a burner assembly comprising an inner tube locted within and spaced inwardly from said radiant tube, said inner tube having a forward discharge end, means for delivering combustion air into said inner tube for flow toward the forward end of said inner tube, a gas supply pipe located within said inner tube and having a forward end, means for delivering gaseous fuel to said gas supply pipe for flow toward the forward end of said gas supply pipe, a tubular nozzle on the forward end portion of said gas supply pipe and adapted to receive fuel from said supply pipe, said nozzle being at least partially disposed within said inner tube and coacting therewith to define an annular passage permitting combustion air to flow out of the forward end of said inner tube, openings in said nozzle and permitting a portion of the combustion air in said inner tube to flow into said nozzle and mix with the fuel therein, means adjacent said nozzle for igniting the fuel-air mixture discharged from said nozzle and thereby produce a flame, and means mounting said nozzle for selective back and forth adjustment relative to the forward end of said tube thereby to enable said flame to be shortened and lengthened.

2. A radiant tube heating system as defined in claim 1 in which said nozzle is shaped as a frustum which increases in diameter upon progressing forwardly.

3. A radiant tube heating system as defined in claim 2 further including angularly spaced fins on the outer surface of said frustum and shaped to cause spinning of the combustion air flowing past said outer surface.

4. A radiant tube heating system as defined in claim 1 in which said openings are defined by first and second axially spaced rows of angularly spaced holes formed through said nozzle.

5. A radiant tube heating system as defined in claim 1 in which said nozzle is telescoped with said gas supply pipe, said mounting means comprising means selectively operable to permit said nozzle to slide back and forth relative to said pipe and to lock said nozzle rigidly to said pipe.

6. A radiant tube heating system comprising an outer radiant tube made of heat-resistant material, a burner assembly comprising an inner tube located within and spaced inwardly from said radiant tube, said inner tube having a forward discharge end, means for delivering combustion air into said inner tube for flow toward the forward end of said inner tube, a fuel supply pipe located within said inner tube and having a forward end, means for delivering gaseous fuel to said supply pipe for flow toward the forward end of said supply pipe, a tubular nozzle on the forward end portion of said supply pipe and adapted to receive fuel from said pipe, said nozzle being at least partially disposed in said inner tube and being formed with openings permitting some of the combustion air in said inner tube to flow into said nozzle as primary combustion air and to mix with the fuel therein, said nozzle coacting with said inner tube to define an annular passage permitting a stream of secondary combustion air to flow out of the forward end of said inner tube and to mix with the fuel-air mixture discharged from said nozzle, means adjacent said nozzle for igniting said fuel-air mixture and thereby produce a flame, and means mounting said nozzle for selective back and forth adjustment on the forward end portion of said supply pipe thereby to enable said openings to be adjusted back and forth relative to the forward end of said inner tube so as to permit changing of the ratio of primary combustion air to secondary combustion air and permit changing of the length of said flame.

7. A radiant tube heating system as defined in claim 6 in which said nozzle is shaped as a frustum which increases in diameter upon progressing forwardly, angularly spaced fins on the outer surface of said frustum and shaped to cause spinning of the combustion air flowing past said outer surface, said openings being defined by first and second axially spaced rows of angularly spaced holes formed through said frustum.

* * * * *